US005862963A

United States Patent [19]

Fuchs et al.

[11] Patent Number: 5,862,963

[45] Date of Patent: Jan. 26, 1999

[54] DISPENSING CLOSURE

[75] Inventors: Timothy J. Fuchs, Perrysburg; James M. Bianca, Jr., Toledo, both of Ohio

[73] Assignee: Owens-Illinois Closure Inc., Toledo, Ohio

[21] Appl. No.: 905,272

[22] Filed: Aug. 6, 1997

[51] Int. Cl.[6] ..... B67D 3/00; B67D 5/32; B67D 5/33; B67B 5/00

[52] U.S. Cl. ..... 222/536; 222/153.05; 222/153.06; 222/153.13

[58] Field of Search ..... 222/153.05, 153.06, 222/153.13, 536

[56] References Cited

U.S. PATENT DOCUMENTS

| | | | |
|---|---|---|---|
| D. 292,889 | 11/1987 | Ostrowsky . | |
| D. 343,358 | 1/1994 | Lay et al. . | |
| D. 346,963 | 5/1994 | Crawford . | |
| D. 352,661 | 11/1994 | Powers . | |
| 3,223,287 | 12/1965 | Sagarin . | |
| 3,318,494 | 5/1967 | Porter et al. . | |
| 3,516,581 | 6/1970 | Micallef | 222/529 |
| 3,542,256 | 11/1970 | Waterman . | |
| 3,568,895 | 3/1971 | Porter . | |
| 3,734,359 | 5/1973 | Waterman . | |
| 3,774,822 | 11/1973 | Hazard | 222/534 |
| 4,081,108 | 3/1978 | Wilson et al. . | |
| 4,095,725 | 6/1978 | Goncalves . | |
| 4,452,364 | 6/1984 | Kay . | |
| 4,487,342 | 12/1984 | Shy . | |
| 4,538,745 | 9/1985 | Dunning et al. | 222/153.06 |
| 4,607,768 | 8/1986 | Taber et al. . | |
| 4,610,371 | 9/1986 | Karkiewicz . | |
| 4,645,086 | 2/1987 | Rosenthal . | |
| 4,711,372 | 12/1987 | Gach . | |
| 4,776,501 | 10/1988 | Ostrowsky . | |
| 4,805,792 | 2/1989 | Lecinski, Jr. . | |
| 4,962,869 | 10/1990 | Gross et al. . | |
| 5,152,432 | 10/1992 | De Laforcade . | |
| 5,192,005 | 3/1993 | Zimmerman . | |
| 5,205,424 | 4/1993 | Gaspar . | |
| 5,236,107 | 8/1993 | Spaanstra, Sr. . | |
| 5,279,451 | 1/1994 | Mueller et al. . | |
| 5,284,264 | 2/1994 | Gross . | |
| 5,341,960 | 8/1994 | Lay . | |
| 5,346,100 | 9/1994 | Lay | 222/536 |

*Primary Examiner*—Andres Kashnikow
*Assistant Examiner*—Keats Quinalty

[57] ABSTRACT

A dispensing closure includes a body on which an actuator supporting an outlet passage is pivoted about a transverse pivot axis. A post is integrally supported on the upper part of the body and extends adjacent and below the pivot axis. The actuator includes an abutting surface which extends axially when the actuator is in a position to close the outlet and is adjacent the post. Upon the first movement of the actuator, the abutting surface contacts the post with a transverse force that breaks the post. In a preferred embodiment, the post is formed on a transverse wall of the body and extends axially along an inner surface of the body. The post extends axially in cantilever fashion. A thin membrane may connect the post to the upper part of the body. The abutting surface is provided on an annular skirt on the actuator and comprises a recess in the skirt defining the abutting surface. Preferably, the skirt of the actuator includes a convex free edge which is adapted cooperate with axial ribs on the transverse wall of the closure to absorb any excess force on the actuator during normal operation by contact of the convex surface with inclined surfaces on the free ends of the axial ribs. In a modified form, the body is made integral with the container.

12 Claims, 3 Drawing Sheets

DISPENSING CLOSURE

This invention relates to dispensing closures and particularly to a dispensing closure that includes an actuator which supports an outlet passage wherein the actuator is tiltable relative to the closure to position the outlet passage for dispensing the contents of a container.

BACKGROUND AND SUMMARY OF THE INVENTION

In one of the well known types of dispensing closure such as shown in U.S. Pat. No. 3,516,58, the closure includes a body and an actuator pivoted on the body. The actuator includes a dispensing opening which is exposed when the actuator is moved from a closed to an open position.

It is desirable to provide a construction wherein a greater force is required initially to use the dispensing closure and upon the first movement of the actuator to the open position, a lesser force is thereafter used. Such a construction permits handling and shipment of the filled containers with a dispensing closure without inadvertent opening of the closure. In one type of such dispensing closure, an abutment is broken upon first actuation of the actuator as in U.S. Pat. Nos. 3,223,287, 3,318,494, 3,568,895, 4,095,725, 5,346,100 and 5,341,960. In another type, an abutment is permanently deformable on first use of the actuator as in U.S. Pat. No. 4,962,869.

Among the objectives of the present invention are to provide a dispensing closure of the type which is constructed to require a greater force initially to use the dispensing closure and upon first movement of the actuator to an open position, a lesser force is required; wherein an abutment or post is broken; wherein the force for breaking the post can be more readily controlled during design and manufacture of the dispensing closure; wherein the post is broken by a force applied to the post transversely such that there is greater assurance that the post will be broken.

In accordance with the invention, the dispensing closure includes a body on which an actuator supporting an outlet passage is pivoted about a transverse pivot axis. A post is integrally supported on the upper part of the body and extends adjacent and below the pivot axis. The actuator includes an abutting surface which extends axially when the actuator is in a position to close the outlet and is adjacent the post. Upon the first movement of the actuator, the abutting surface contacts the post with a transverse force that breaks the post. In a preferred embodiment, the post is formed on a transverse wall of the body and extends axially along an inner surface of the body. The post extends axially in cantilever fashion. A thin membrane may connect the post to the upper part of the body. The abutting surface is provided on an annular skirt on the actuator and comprises a recess in the skirt defining the abutting surface. Preferably, the skirt of the actuator includes a convex free edge which is adapted cooperate with axial ribs on the transverse wall of the closure to absorb any excess force on the actuator during normal operation by contact of the convex edge with inclined surfaces on the free ends of the axial ribs. In a modified form, the body is made integral with the container.

DETAILED DESCRIPTION OF THE PREFERRED EMBODIMENTS

Figure 1:
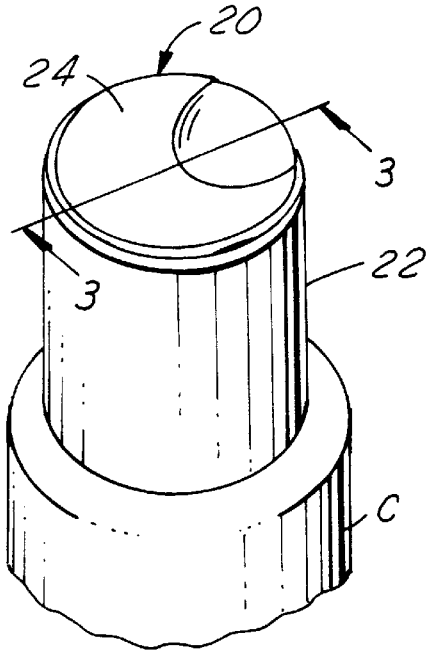
FIG. 1 is a fragmentary perspective view of a dispensing closure embodying the invention on a container.
Figure 2:
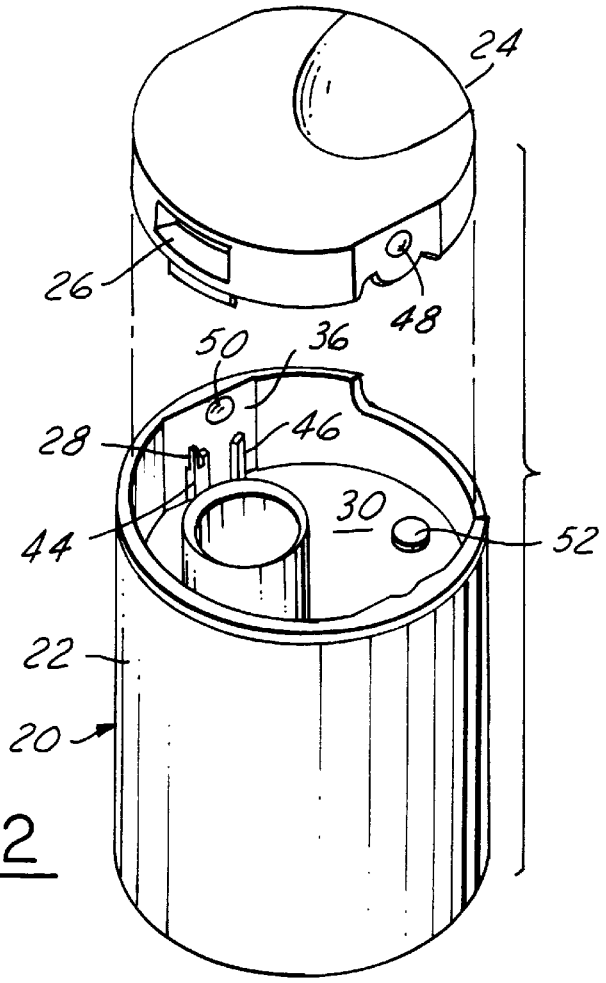
FIG. 2 is an exploded perspective view of the dispensing closure.
Figure 3:
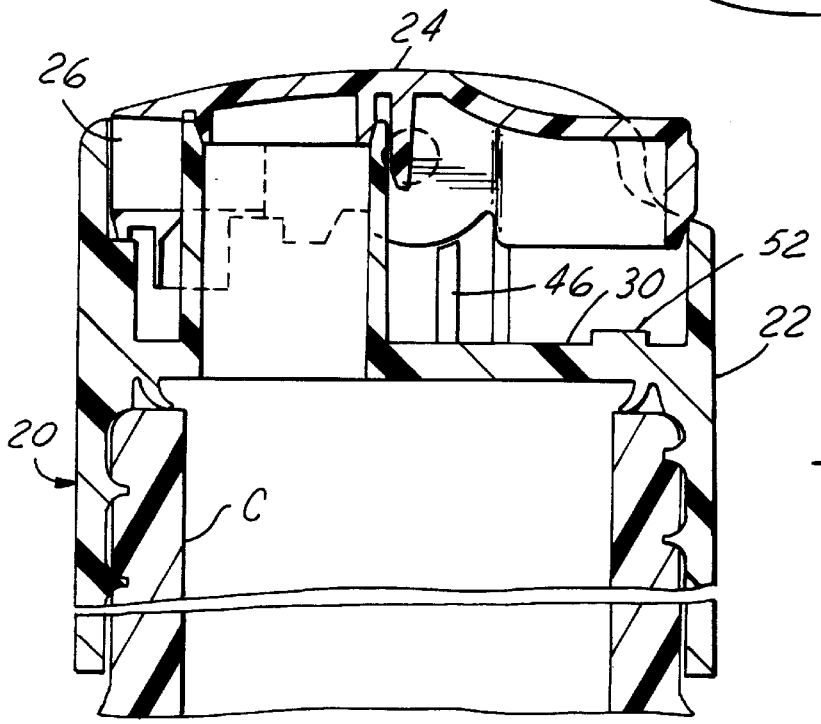
FIG. 3 is a fragmentary sectional view taken along the line 3—3 in FIG. 1.
Figure 4:
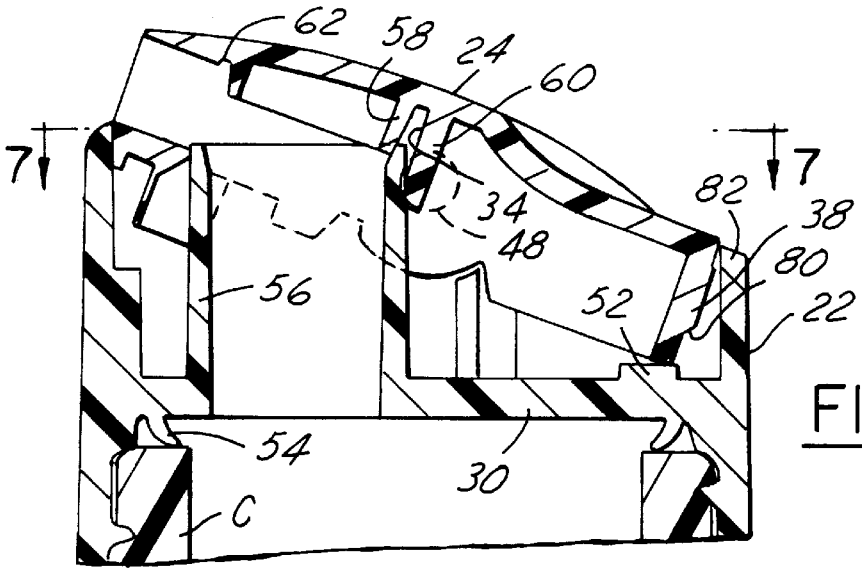
FIG. 4 is a fragmentary sectional view similar to FIG. 3 showing the actuator in open position.
Figure 5:
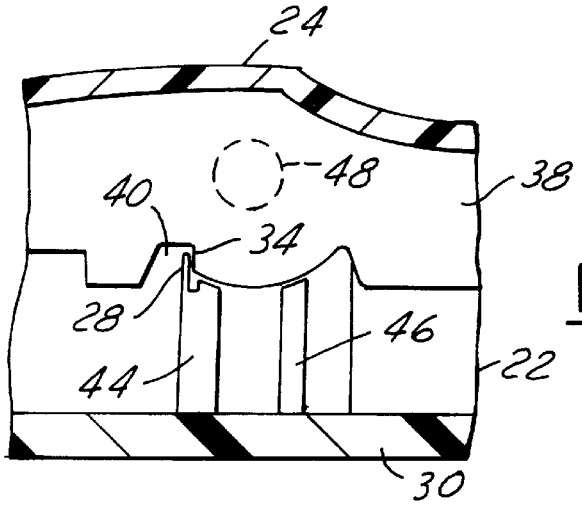
FIG. 5 is a fragmentary sectional view of a portion of the dispensing closure shown in FIG. 3, parts being broken away.
Figure 6:
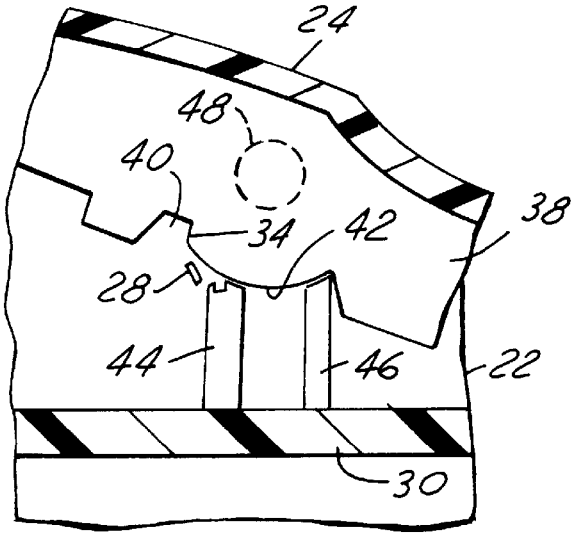
FIG. 6 is a fragmentary sectional view similar to FIG. 5 showing the actuator as it is first moved to an open position.

In accordance with the invention, as shown in FIG. 1, the dispensing closure 20 is applied to a container C by interengaging means, such as threads on the closure and container. Referring to FIG. 2, the dispensing closure 20 includes a body 22 on which an actuator 24 is pivoted to body 22 about a transverse pivot axis, as presently described. Actuator 24 includes an integral outlet passage 26. As shown in FIGS. 2, 8, 9 and 10, a post 28 is integrally supported on the upper part of the body 22 and extends adjacent and below the pivot axis. The actuator 24 includes an abutting surface 4 which extends axially when the actuator 24 is in a position to close the outlet and is adjacent the post 28 (FIG. 5). Upon the first movement of the actuator 24, the abutting surface 4 contacts the post 28 with a transverse force that breaks the post 28 (FIG. 6).

Figure 9:
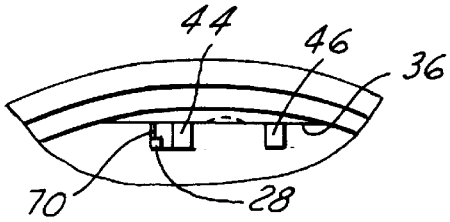
FIG. 9 is a fragmentary view similar to FIG. 7 of a modified form of dispensing closure.

In a preferred embodiment, the post 28 is formed on a portion of body 22 which is a transverse wall of the body 22 and extends axially along an inner surface of peripheral wall 36 of the transverse wall 30 of the body 22 (FIG. 9). The abutting surface 32 is provided on an annular peripheral skirt 38 of the actuator 24 and comprises a recess 40 in the skirt 38 defining the abutting surface 4. Preferably, the skirt 38 of the actuator 24 includes a convex free edge 42 which is adapted to cooperate with axial ribs 44,46 on the transverse wall 30 of the closure body 22 to absorb any excess force when excess force is applied on the actuator 24 during normal operation by contact of the convex edge 42 with inclined surfaces 48 on the free ends of the axial ribs 44,46.

Axial post 28 extends upwardly from axial rib 44 and is integrally attached thereto only on the lower end such that the post 28 is spaced from the inner surface 36 of body 22. In other words, post 28 is attached in cantilever fashion.

The actuator 24 is preferably pivoted to body 2 about a diametrical axis defined by engagement of spherical enlargements 48 on the skirt 38 of actuator 24 engaging complementary recesses 50 on the inner surface 36 of body 22.

Figure 7:
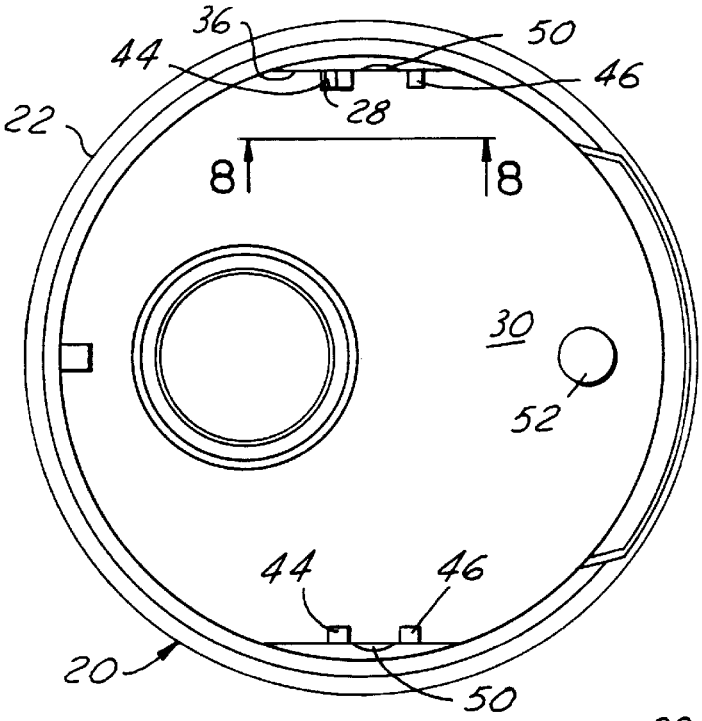
FIG. 7 is a top plan view of the body of the dispensing closure with the actuator removed.
Figure 8:
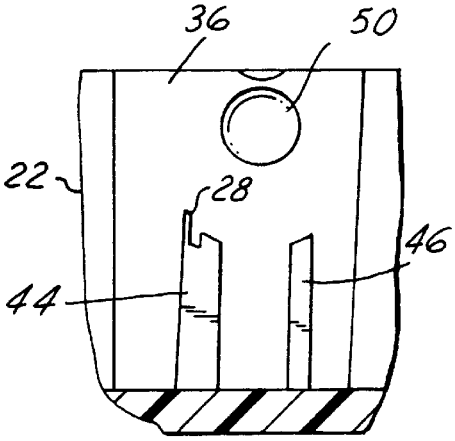
FIG. 8 is a fragmentary sectional view taken along the line 8—8 in FIG. 7.

In all other respects, the dispensing closure is in accordance with the aforementioned U.S. Pat. No. 3,516,581, incorporated herein by reference. An upstanding raised portion 52 on the transverse wall 30 is engaged by the free edge of the peripheral skirt 38 of the actuator 24 to limit the open position (FIG. 7). An integral annular flexible seal 54 is provided on the underside of transverse wall 30 and engages the upper end of the threaded finish of container C when the closure 20 is applied to the container C by threading the body 22, which has internal threads on the lower portion below wall 30. The dispensing closure body 22 has an axial outlet tube 56 that extends axially upwardly from the transverse wall 30 of the body 22. The actuator 24 includes an integral inner annular seal 58 and semi-circular seals 60,62 that extend axially downwardly and cooperate with the tube 56 to provide a seal in both the closed and open positions of the actuator 24. An axial projection or bump 80 on the skirt 38 of the actuator 24 cooperates with the upper portion 82 of the body 22 to provide a force to tend to hold the actuator in open position and closed position which also provides a snap action.

As shown in FIG. 9, in a modified form, an integral thin membrane 70 is provided between the peripheral wall 36 and the post 28 to facilitate manufacture.

Figure 10:
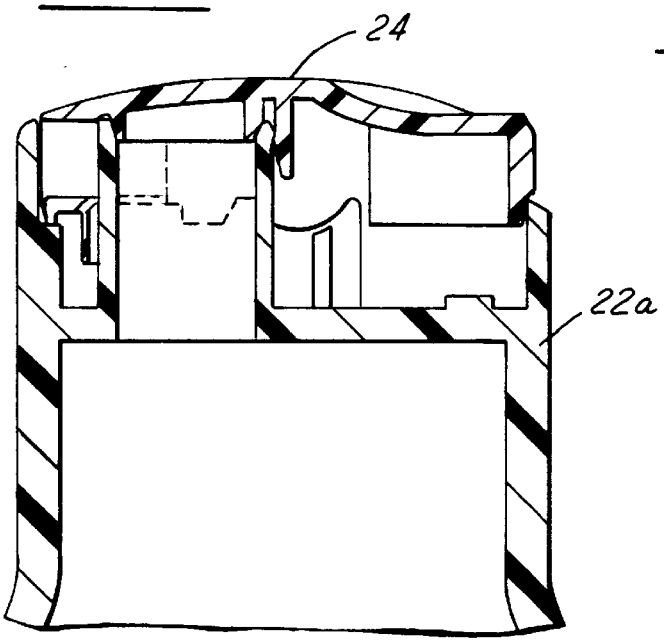
FIG. 10 is view similar to FIG. 3 of a form of the invention wherein the dispensing closure is made an integral part of the container.

Although the invention has been described as being a separate closure attached to a container, it may also be used wherein the body 22*a* is made as an integral part of the container as shown in FIG. 10.

It can thus been seen that there has been provided a dispensing closure including a body on which an actuator supporting an outlet passage is pivoted about a transverse pivot axis. A post is integrally supported on the upper part of the body and extends adjacent and below the pivot axis. The actuator includes an abutting surface which extends axially when the actuator is in a position to close the outlet and is adjacent the post. Upon the first movement of the actuator, the abutting surface contacts the post with a transverse force that breaks the post. In a preferred embodiment, the post is formed on a transverse wall of the body and extends axially along an inner surface of the body. The post extends axially in cantilever fashion. A thin membrane may connect the post to the upper part of the body. The abutting surface is provided on an annular skirt on the actuator and comprise a recess in the skirt defining the abutting surface. Preferably, the skirt of the actuator includes a convex free edge which is adapted cooperate with axial ribs on the transverse wall of the closure to absorb any excess force on the actuator during normal operation by contact of the convex surface with inclined surfaces on the free ends of the axial ribs. In a modified form, the body is made integral with the container.

We claim:

1. A dispensing closure comprising a plastic body having a vertical axis, an axial wall portion and integral circumferentially spaced ribs adjacent to said wall portion and spaced below the pivot axis, and upper ends of said ribs having surfaces inclined downwardly toward one another, a plastic actuator, interengaging means between said body and said actuator pivoting said actuator about a transverse pivot axis wherein a dispensing opening in said actuator is moved between a closed and an open position, an axial post on said body integrally extending from one of said ribs adjacent to and below the pivot axis, said actuator including a downwardly extending convex surface adapted to engage the inclined surfaces on the ribs if excessive axial force is applied to said actuator, and an abutting surface which extends axially when the actuator is in the closed position and is adjacent said post such that, upon first movement of the actuator from the closed position to the open position, the abutting surface contacts the post with a transverse force that breaks the post.

2. The dispensing closure set forth in claim 1 wherein said body includes a transverse wall and said ribs extend axially upwardly from said transverse wall.

3. The dispensing closure set forth in claim 1 wherein said actuator includes a base wall and a peripheral skirt and said abutting surface is on said peripheral skirt adjacent to said interengaging means.

4. The dispensing closure set forth in claim 1 wherein said body includes a transverse wall and said ribs extend axially upwardly from said transverse wall, and said actuator includes a base wall and a peripheral skirt and said abutting surface is on said peripheral skirt adjacent to said interengaging means.

5. The dispensing closure set forth in claim 1 wherein said actuator includes a base wall and a peripheral skirt, said downwardly extending concave surface being on said skirt.

6. The dispensing closure set forth in claim 1 including a thin membrane extending between said axial wall portion of said body and said post.

7. The dispensing closure set forth in claim 6 wherein said post is rectangular and has a comer and said membrane extends between said inner surface of said wall portion and said corner.

8. The dispensing closure set forth in claim 1 including a container, said container having an open upper end defining said body of said dispensing closure wherein said axial wall portion and said ribs are integral with said open upper end.

9. The dispensing closure set forth in claim 8 wherein said body includes a transverse wall and said ribs extends axially upwardly from said transverse wall.

10. The dispensing closure set forth in claim 8 wherein said actuator includes a base wall and a peripheral skirt and said abutting surface is on said peripheral skirt adjacent to said interengaging means.

11. The dispensing closure set forth in claim 8 wherein said body includes a transverse wall and said ribs extend axially upwardly from said transverse wall, and said actuator includes a base wall and a peripheral skirt and said abutting surface is on said peripheral skirt adjacent to said interengaging means.

12. The dispensing closure set forth in claim 8 wherein said actuator includes a base wall and a peripheral skirt, said downwardly extending concave surface being on said skirt.

* * * * *